US011059309B2

(12) United States Patent
Morral et al.

(10) Patent No.: US 11,059,309 B2
(45) Date of Patent: Jul. 13, 2021

(54) CALIBRATING PRINTING STATIONS

(71) Applicant: HEWLETT-PACKARD DEVELOPMENT COMPANY, L.P., Houston, TX (US)

(72) Inventors: Pol Morral, Sant Cugat del Valles (ES); Sergi Culubret, Sant Cugat del Valles (ES); Gerard Mosquera, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 154 days.

(21) Appl. No.: 16/093,948

(22) PCT Filed: May 12, 2016

(86) PCT No.: PCT/EP2016/060677
§ 371 (c)(1),
(2) Date: Oct. 15, 2018

(87) PCT Pub. No.: WO2017/194116
PCT Pub. Date: Nov. 16, 2017

(65) Prior Publication Data
US 2019/0105928 A1 Apr. 11, 2019

(51) Int. Cl.
*B41J 29/06* (2006.01)
*B41J 19/00* (2006.01)

(52) U.S. Cl.
CPC ..... *B41J 29/06* (2013.01); *B41J 19/00* (2013.01)

(58) Field of Classification Search
CPC ..... B41J 29/06
See application file for complete search history.

(56) References Cited

U.S. PATENT DOCUMENTS

| | | | | |
|---|---|---|---|---|
| 5,204,055 | A * | 4/1993 | Sachs | B05C 19/04 419/2 |
| 7,736,578 | B2 | 6/2010 | Ederer | |
| 8,366,432 | B2 | 2/2013 | Perret et al. | |
| 2006/0249485 | A1 | 11/2006 | Partanen | |
| 2007/0057412 | A1 | 3/2007 | Weiskopf | |
| 2010/0243123 | A1 | 9/2010 | Ederer | |
| 2012/0044310 | A1 | 2/2012 | Yajima | |
| 2013/0000553 | A1 | 1/2013 | Hoechsmann | |

(Continued)

FOREIGN PATENT DOCUMENTS

| | | |
|---|---|---|
| CN | 102670070 | 9/2012 |
| CN | 105149577 | 12/2015 |

(Continued)

OTHER PUBLICATIONS

"3D Printer Cart"; Nov. 8, 2014; http://airwolf3d.com/shop/3d-printer-cart-base-model.

*Primary Examiner* — Jennifer E Simmons
(74) *Attorney, Agent, or Firm* — Fabian VanCott

(57) ABSTRACT

Printing stations to receive build units are disclosed. The printing stations may comprise a first wall comprising two fixed receiving ports to engage with two fixed mounting elements of the build units, respectively, and a second wall comprising a third fixed receiving port to engage with a third fixed mounting element of the build units, and a calibration receiving port to be coupled to a fourth fixed mounting element when the build unit is inserted into the printing station.

19 Claims, 9 Drawing Sheets

(56) References Cited

U.S. PATENT DOCUMENTS

| | | | | |
|---|---|---|---|---|
| 2014/0265045 | A1 | 9/2014 | Cullen | |
| 2017/0210033 | A1 * | 7/2017 | Overgaauw | B29C 64/106 |

FOREIGN PATENT DOCUMENTS

| | | | | |
|---|---|---|---|---|
| CN | 105291435 | | 2/2016 | |
| CN | 205044183 | | 2/2016 | |
| CN | 105579218 | | 5/2016 | |
| EP | 0379863 | A1 * | 8/1990 | A21B 3/07 |
| EP | 1704989 | | 9/2006 | |
| EP | 1721725 | | 11/2006 | |
| EP | 2660064 | | 11/2013 | |

* cited by examiner

CALIBRATING PRINTING STATIONS

BACKGROUND

Most digital printing technologies are component based. For example, some inkjet printing technologies use printing fluid (e.g., ink) cartridges, some laser printing technologies use toner cartridges and some powder-processing 3D printing technologies use build modules that may be inserted into a printing station or a build material management system.

BRIEF DESCRIPTION

Some non-limiting examples of the present disclosure are described in the following with reference to the appended drawings, in which:

FIG. 1A and FIG. 1B schematically illustrate a printing station according to example implementations;

FIG. 1C to FIG. 1F schematically illustrate details of the example printing station of FIGS. 1A and 1B;

FIG. 2 schematically illustrates an example warped plane;

FIG. 3A and FIG. 3B schematically illustrates a build unit according to example implementations;

FIG. 4 schematically illustrates a printing system according to an example;

DETAILED DESCRIPTION

When printing stations are moved from one point to another, for example from a factory to a client's site, the print stations may be subject to different environmental or situational circumstances. For example, in some scenarios, the flatness or degree of levelness of the floor in the factory may be different from the floor at the installation location. Some printing stations may not be sufficiently rigid and can tend to copy the profile of the surface on which they are installed. Differences between floors or other surfaces on which a printing station is installed may cause printing stations to lose their geometrical alignment or accuracy and cause errors or decreased performance or print quality.

Figure 1A:
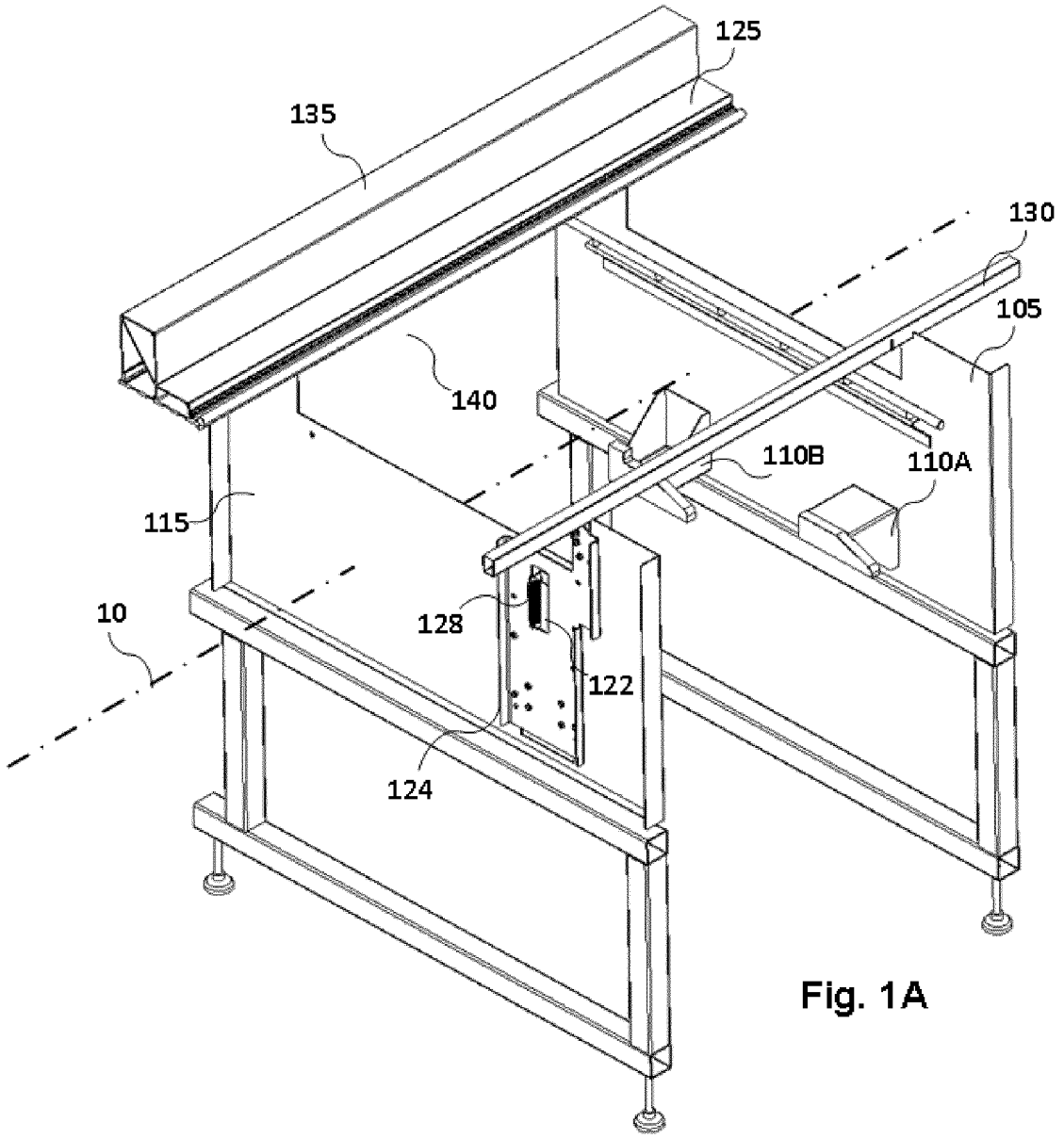
Figure 1B:
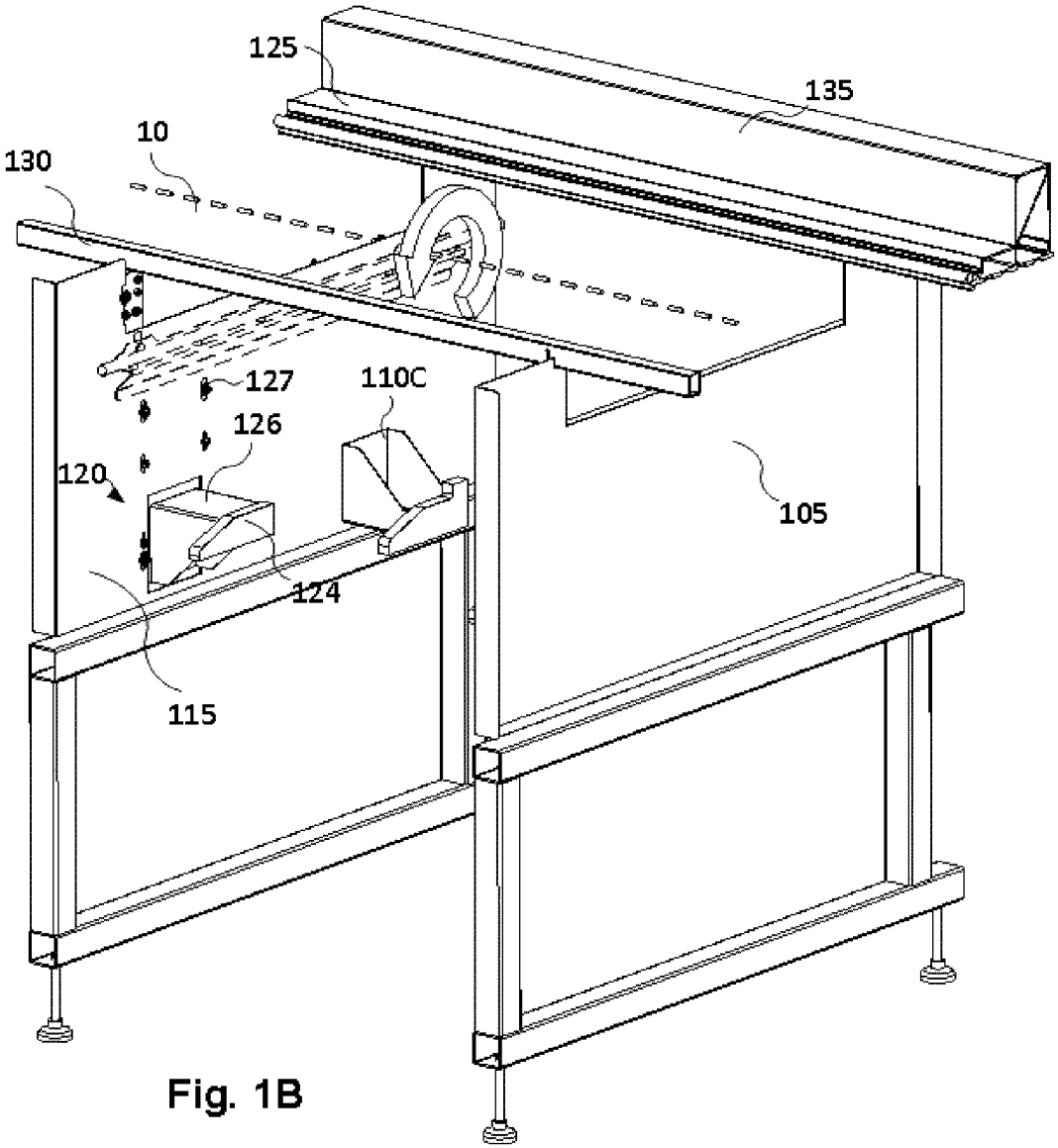

FIG. 1A and FIG. 1B schematically illustrate a printing station according to example implementations. As shown, printing station 100 may include a first wall 105 and a second wall 115. The two walls 105 and 115 may be connected at one edge through a connecting structure 135. The connecting structure 135 may comprise a fixed linear guide element 125. The two walls 105 and 115 may also be connected with a moveable linear guide element 130. The moveable linear guide element 130 may be fixedly coupled at one end to the first wall 105 and to a moveable port element 124 at another end. The moveable linear guide element 130 may be an additional link between the first wall 105 and the second wall 115. In some implementations the linear guide elements 125 and 130 may also act as a guide for printing modules, such as printing fluid agent deposition modules, that may be displaceable in a direction between the two walls. In some examples the printing station may comprise a third wall 140, attached to and perpendicular to the first wall 105 and to the second wall 115. In some implementations, the third wall 140 may comprise the connecting structure 135.

The printing station structure may tend to twist or deform along a twisting axis 10 when copying a potentially irregular floor that may be present below the printing station. Due to this deformation, a plane defined by linear guide elements 125 and 130 may become warped.

Figure 1C:
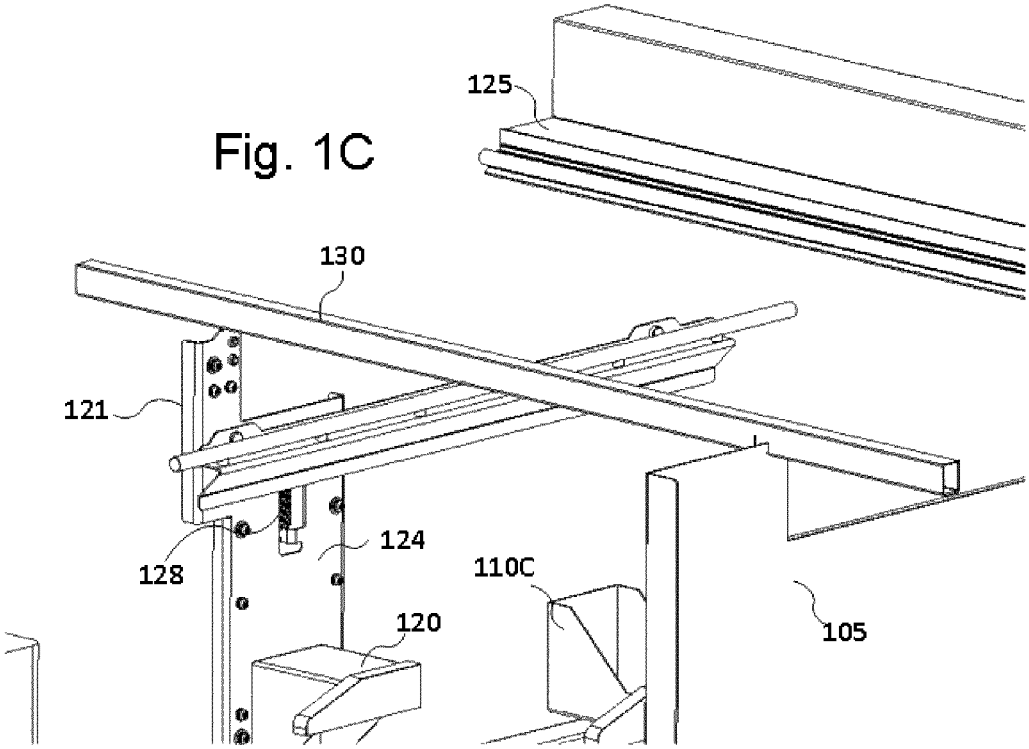

FIG. 1C schematically illustrates a detail of printing station 100. The printing station 100 may comprise a moveable element 124. The moveable element may comprise a calibration receiving port 120, a vertical beam 121 and the moveable linear guide element 130. Movement of the moveable element 124 may allow the linear guide element 130 to be aligned with the linear guide element 125 that is part of rigid structure 135.

Figure 1D:
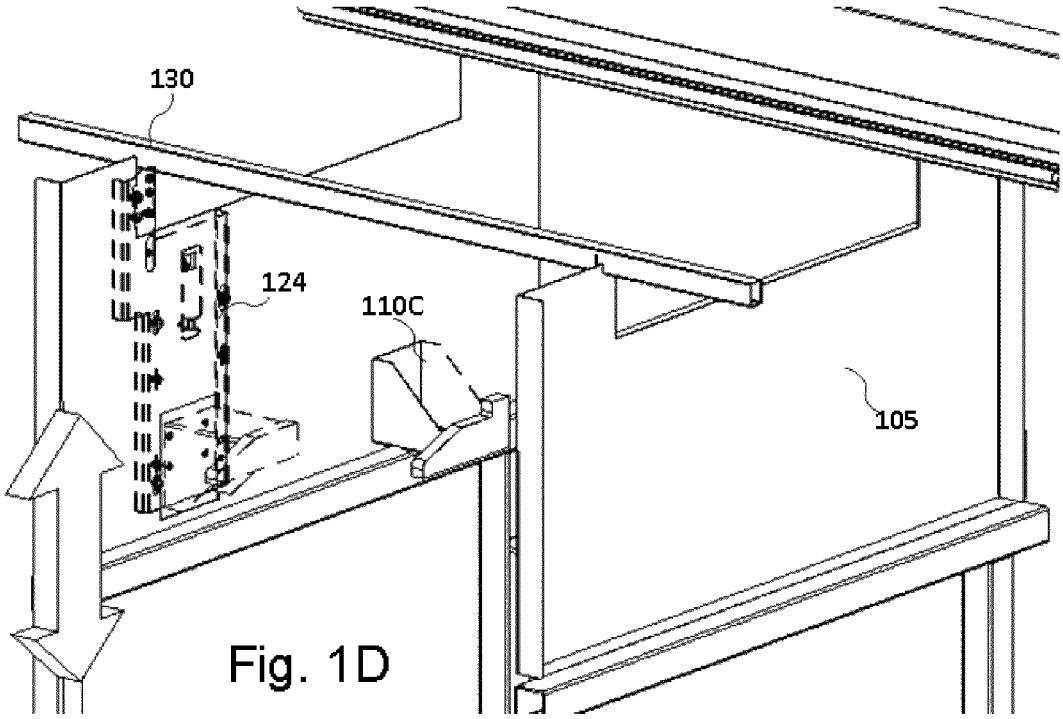
Figure 1E:
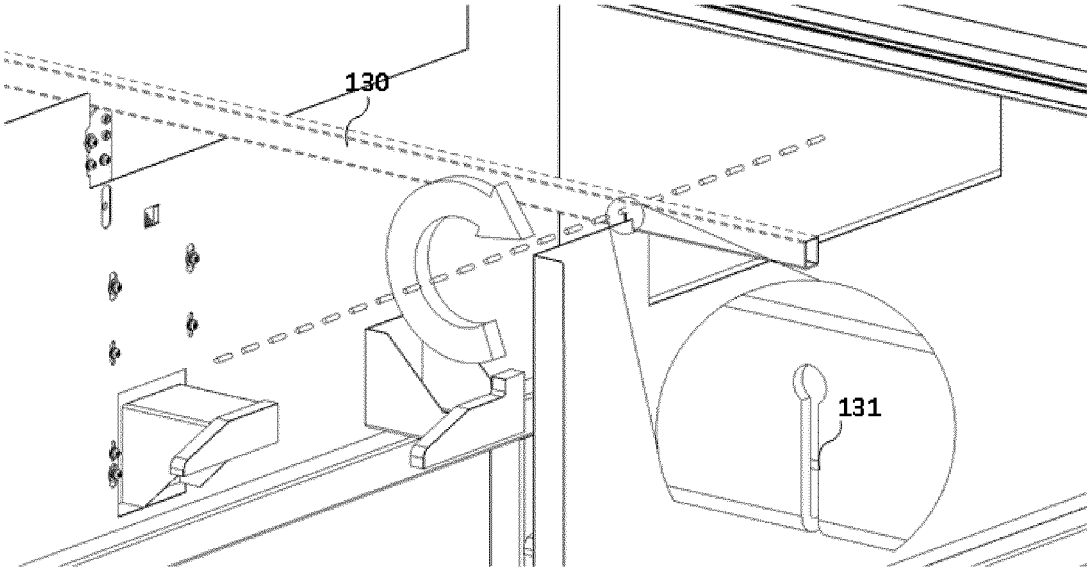

FIG. 1D schematically illustrates another detail of the printing station 100. During a print station calibration process, the moveable element 124 may be displaced, e.g. upwards or downwards. Such a displacement may cause the linear guide element 130 to rotate, as indicated by the curved arrow in FIG. 1E, and impose a stress to the part of the linear guide element 130 that is fixed to wall 105. The linear guide element 130 may thus comprise, as indicated in FIG. 1E, a pivot slot 131 to facilitate movement of the other part of the linear guide element 130 that is closer to the wall 115, when the moveable element 124 is displaced.

Figure 1F:
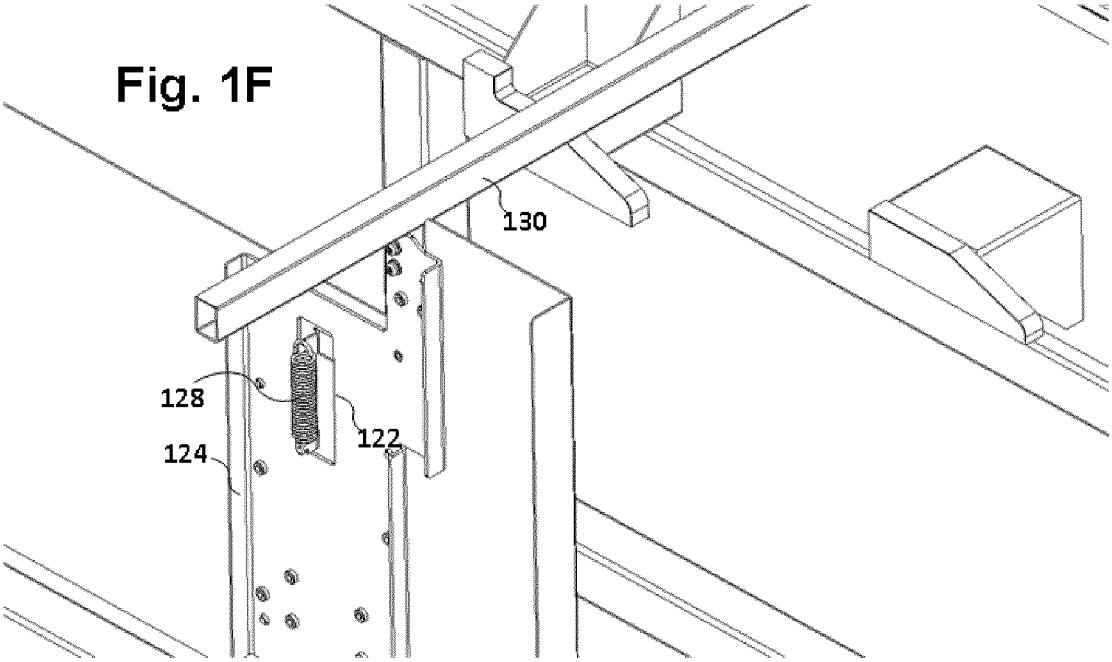

FIG. 1F schematically illustrates another detail of printing station 100. Printing station 100 may comprise a spring 128 attached at one end to wall 115 and at another end to moveable element 124. The spring may be located in a guiding track 122.

Figure 2:
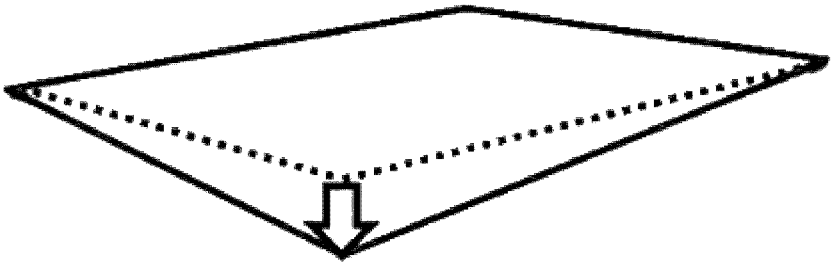

FIG. 2 schematically illustrates a warped plane with 4 vertices. In FIG. 2, one of the vertices may get displaced from the plane created by the other three. In the example of FIGS. 1A and 1B, the printing station may stand on four feet. The warping effect in FIG. 2 represents the effect of one of the four print station feet falling off the plane created by the other three when the machine is standing on an irregular floor.

Figure 3A:
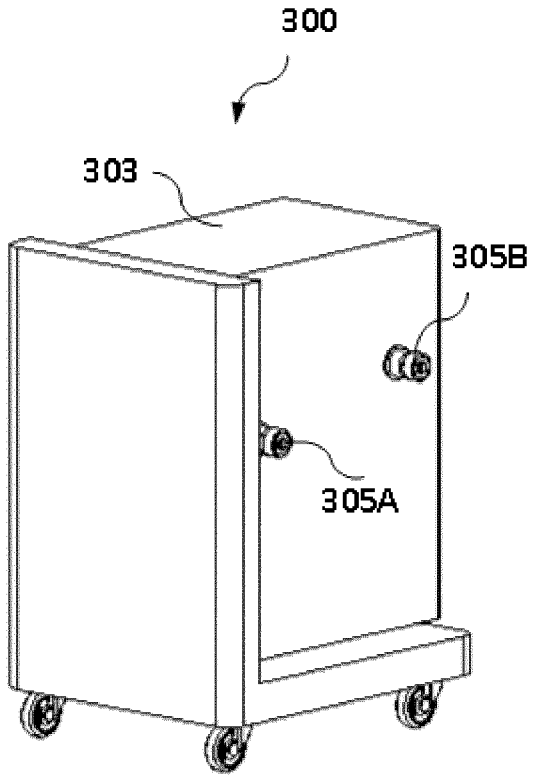
Figure 3B:
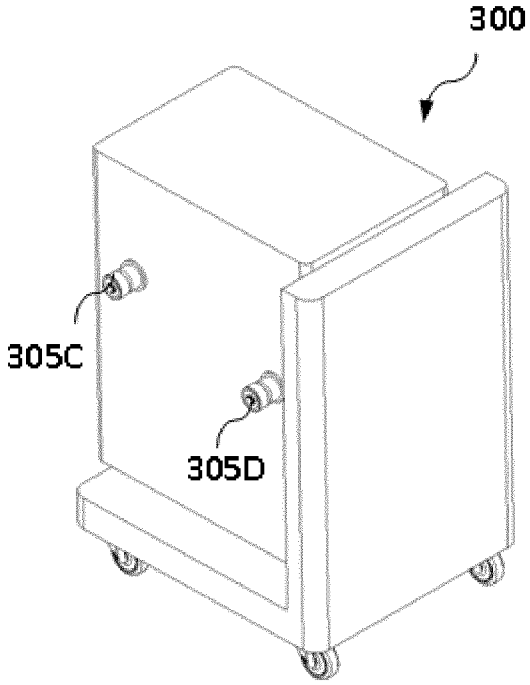

FIG. 3A and FIG. 3B schematically illustrate a build unit that may be inserted into the printing station prior to a printing operation process. The build unit 300 may be rigid enough so as not to deform or warp if an uneven floor is present below, due to its box type closed shape. Its assembly process may guarantee its geometrical accuracy. Four fixed mounting elements, such as bearings 305A, 305B, 305C and 305D may protrude from the lateral sides of the build unit 300 and may serve as references to engage four receiving ports installed in the printing station.

In powdered-processing 3D printing systems, the build unit 300 may comprise a build platform 303 on the top side where powder may be provided. Once inserted into the printing station, to achieve precision, the plane defined by the linear guide elements 125 and 130 is to be aligned with the plane of the top side of the build unit 300.

With reference to FIGS. 1A and 1B, the first wall 105 of the printing station 100 may comprise two fixed receiving ports 110A and 110B. The two fixed receiving ports 110A and 110B may engage, respectively, with two fixed mounting elements of a build unit, such as the mounting elements 305A and 305B of the build unit 300, when the build unit is inserted into the printing station. The second wall 115 may comprise a third fixed receiving port 110C to engage with a third fixed mounting element, such as mounting element 305C of build unit 300, when the build unit is inserted into the printing station 100. The second wall 115 may further comprise the calibration receiving port 120. The calibration receiving port 120 may be coupled to a fourth fixed mounting element, such as mounting element 310D of build unit 300, when the build unit is inserted into the printing station.

In the examples discussed with reference to FIGS. 1A-1F, 3A and 3B, the build unit may be a cuboid and the first and second walls 105 and 115 may be rectangular walls. By coupling the calibration receiving port 120 to the fourth fixed mounting element 305D, any warping effect of a potentially uneven floor may be reversed. More specifically, when all four fixed mounting elements are respectively coupled to the one calibration and three fixed receiving ports, the moving element 124 and the third fixed receiving port 110C may assume the same relative position as the corresponding mounting elements of the build unit. As a result, the horizontal plane defined by the edges at the top of the rectangular walls 105 and 115 may be forced to copy the flatness of the top side of the build unit.

In some examples, the calibration receiving port 120 may comprise a guiding track 122. The guiding track 122 may be fixed to the second wall 115. The calibration receiving port 120 may be part of the moveable port element 124. The moveable port element 124 may be moveably coupled to the guiding track 122. The moveable port element 124 may move in a vertical direction, as indicated in FIG. 1D, and the calibration receiving port 120 may then get in contact or engage with the fourth mounting element (e.g. bearing) of the build unit. The vertical movement of the moveable port element 124 may be facilitated by the existence of the guiding track 122. The guiding track 122 allows for a controlled movement of the moveable port element 124.

In some examples, the guiding track 122 may comprise locking elements 127 to lock the moveable port element 124 to an engaging location when the calibration receiving port 120 is engaged with the fourth fixed mounting element. The locking elements 127 may allow for establishing a stable flatness corresponding to the specific floor on which the printing station 100 may stand. As a result, for as long as the printing station 100 is standing on the same floor, the calibration receiving port 120 may remain at the locked position. This procedure amounts to flatness calibration of the printing station for the particular floor. If the printing station changes location, then the flatness calibration process may be repeated.

In some examples, the calibration receiving port 120 may comprise a receiving portion 126 and a spring 128. The spring 128 may provide movement to the receiving portion 126 in an engaging direction. The engaging direction may be a vertical direction. The spring 128 may be fixed on one side to the wall or to an end of the guiding track 122. For example, the guiding track 122 may comprise a set of guiding points and the spring 128.

When the moveable port element 124 is displaced to meet the fourth fixed mounting element of the build unit, the moveable port element 124 and the one end of the moveable linear guide element 130 may move in unison. As a result, the moveable linear guide element 130 may adapt to the flatness of the build unit and, when the fourth fixed mounting element is successfully coupled to the moveable port element 124, the moveable linear guide element 130 may lay parallel to the build platform of the build unit. Furthermore, after the printing station's flatness is calibrated, the fixed linear guide element 125 and the moveable linear guide element 130 may be arranged in parallel.

Even if the printing station's structure is found in a twisted condition, the moveable port element 124 will copy the build unit's flatness which has an adequate geometrical accuracy to provide precision alignment. Engaging with the build unit's fourth mounting element will also move the moveable linear guide element 130 to its expected position.

Figure 4:
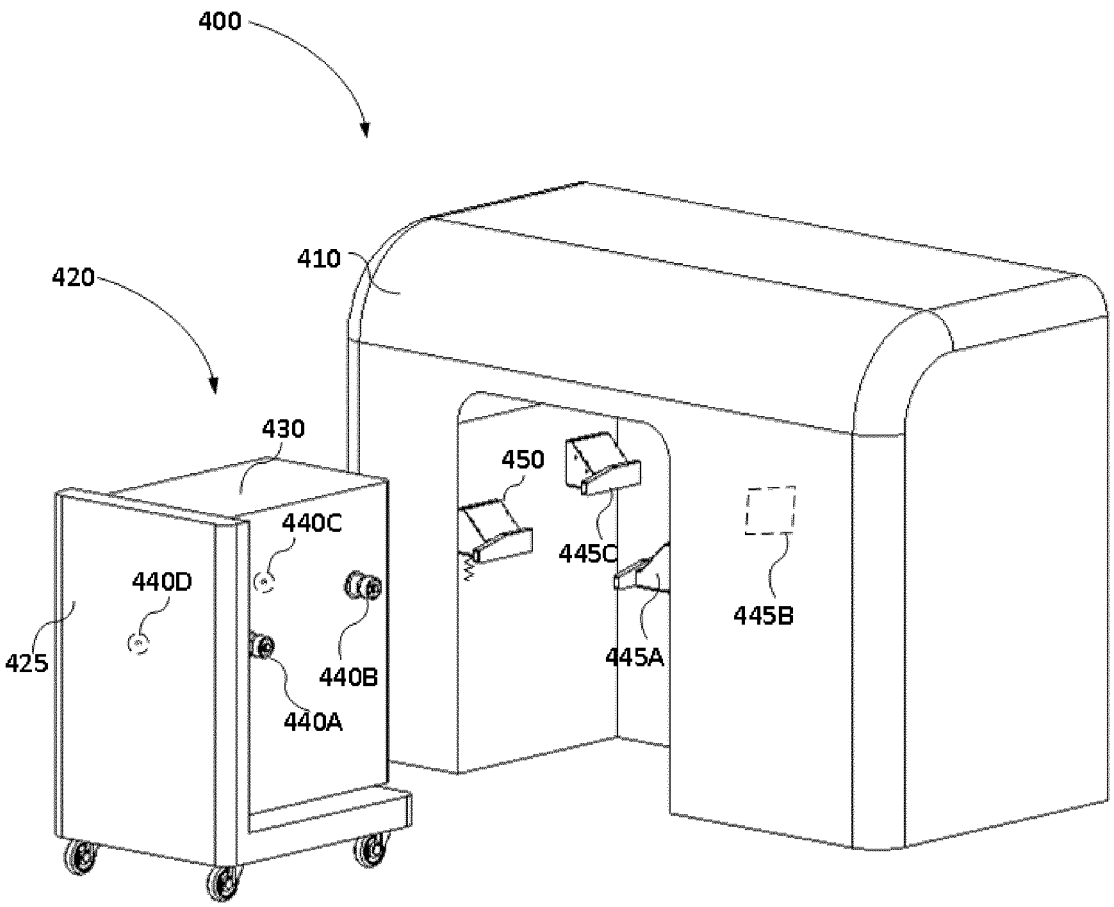

FIG. 4 schematically illustrates a printing system according to an example. The printing system 400 may comprise a printing station 410 and a build unit 420. The build unit may be insertable into the printing station 410. The build unit may comprise a trolley 425 and a print bucket 430. The print bucket may be mounted on the trolley 425. The print bucket 430 may comprise four fixed coupling elements 440A, 440B, 440C and 440D. The four fixed coupling elements 440A, 440B, 440C and 440D may be respectively engageable to three fixed receiving ports 445A, 445B and 445C of the printing station and to a calibration receiving port 450 of the printing station 410.

Each of the fixed coupling elements 440A, 440B, 440C and 440D may comprise a bearing. Accordingly, each of the three fixed receiving port 445A, 445B and 445C as well as the calibration receiving port 450 may comprise a ramp and a pocket. Each ramp may receive and lead the respective bearing to the respective pocket.

Two of the fixed receiving ports may be arranged on a first wall 412 of the printing station 410 whereas the third fixed receiving port and the calibration receiving port may be arranged on a second wall 414 of the printing station. The printing station 410 may comprise a moveable linear guide element 417 fixedly coupled to the first wall 412 and to the calibration receiving port 450. The printing station 410 may comprise a fixed linear guide element 413, fixedly coupled to the first wall 412 and to the second wall 414 and the moveable linear guide element 417 may be aligned parallel to the fixed linear guide element 413 when the calibration receiving port 450 is coupled to the fourth fixed mounting element 445D.

In some examples, the printing system may be a powder-processing 3D printing system. The print bucket may then comprise a top side to receive powder. The printing station may then comprise a printing module. The printing module may be displaceable along a plane defined by the fixed linear guide element and the moveable guide element. The printing module may provide printing fluid, e.g. ink, on at least a part of the powder provided on the build platform of the print bucket. The printing station may further comprise a powder melting heating element, to melt the inked part of the powder.

Figure 5A:
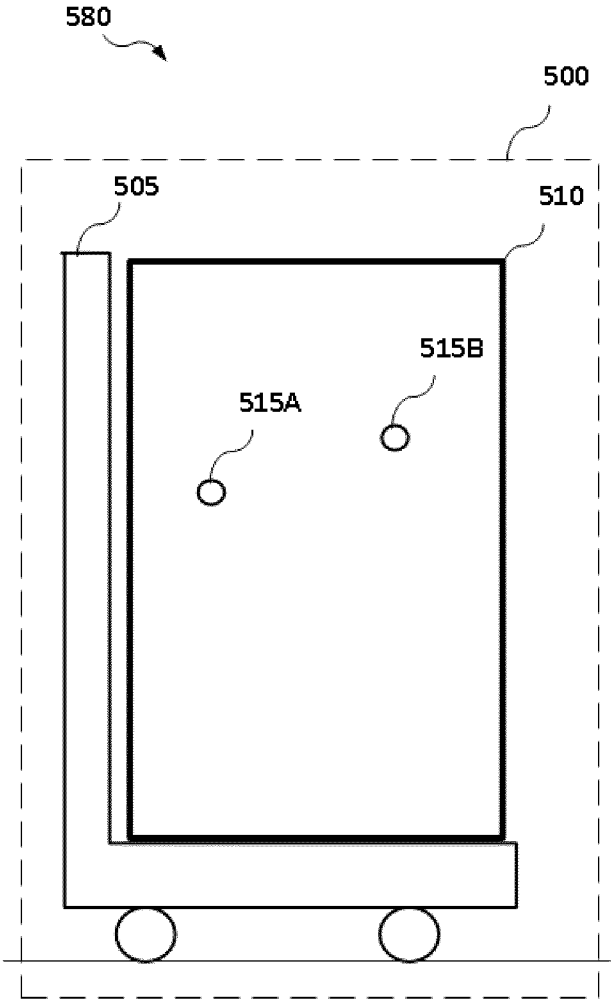
FIG. 5A is a schematic diagram illustrating an example of a build unit for a printing station according to an example implementation.

FIG. 5 is a schematic diagram illustrating an example of a build unit for a printing station according to implementations disclosed herein. The build unit 500 may comprise two separate parts, the trolley 505 and the print bucket 510. In some examples the trolley may always lay on the ground and the print bucket 510 may lay on the trolley 505 when the build unit 500 is outside of the printing station, but may rise to lay on the printing station when the build unit 500 is inside the printing station. In other examples the print bucket 510 may remain on the trolley when mounted on the print station. The print bucket 510 is shown mounted on the trolley 505 in FIG. 5A. The print bucket 510 may comprise a parallelepiped form and may comprise four coupling elements; two may be arranged on a first side while the other two may be arranged on a second side, parallel to the first. FIG. 5A shows one side of the build unit 500. The print bucket 510 may comprise coupling elements 515A and 515B on the one side. The coupling elements 515A and 515B may be bearings.

Figure 5B:
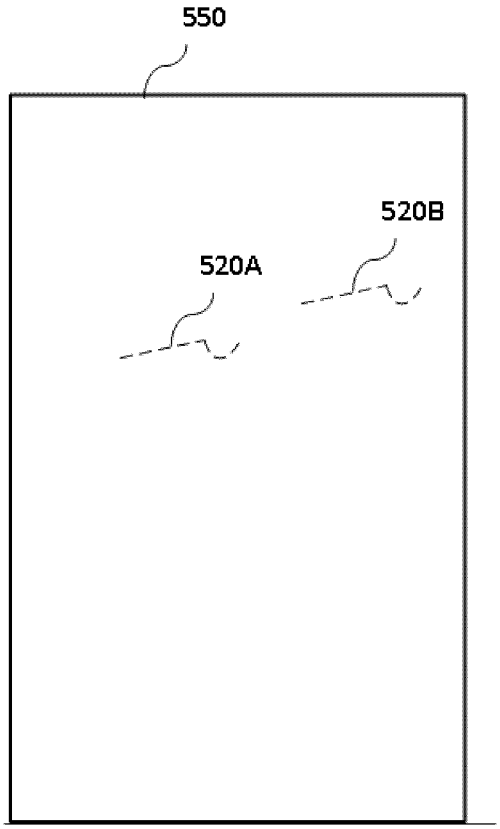
FIG. 5B is a side view of a printing station according to an example implementation.

The build unit 500 may be part of printing system 580. The printing system 580 may also comprise printing station 550. FIG. 5B is a side view of printing station 550. Printing station 550 may receive the build unit 500. The combination of the build unit 500 and printing station 550 may form printing system 580. The printing system may perform a printing job or operation when the printing station 550 and the print bucket 510 are engaged. For that purpose, the printing station may have fixed receiving ports 520A and 520B. The receiving ports 520A and 520B may correspond to the coupling elements 515A and 515B, respectively, when the print bucket 510 is engaged with the printing station 550. It is understood that the printing station may further comprise another pair of receiving ports, a fixed receiving port and a calibration receiving port, to engage with the coupling elements of the other side of the print bucket. The receiving ports 520A and 520B of the example of FIG. 5B may comprise a ramp and a pocket. In other implementations the receiving ports of the printing station 550 may comprise bearings and the coupling elements of the print bucket 510 may comprise ramps and pockets. To facilitate the engagement of the print bucket 500 with the printing station 550, other components may also be used instead of ramps, such as pivoting or lever elements. When a user pushes the trolley, the trolley 505 may carry the print bucket inside the printing station and the bearings 515A and 515B may engage with the ramp of the receiving ports 520A and 520B respectively. The ramps may be inclined so that the bearings 515A and 515B may follow an upwardly route before they reach the respective pockets of the receiving ports 520A and 520B. The user's pushing force may then be converted to a raising force due to the effect of the ramp's slopes. When the bearings 515A and 515B reach the pockets of the receiving ports 520A and 520B, then the print bucket 510 may be referenced against and aligned with the printing station 550 with the use of the calibration receiving port, irrespective of any abnormalities of the ground on which the trolley remains.

The printing system 580 may comprise a printing mode and a resting mode. During the printing mode the print bucket 510 may be mounted on the printing station 550. This implies that the print bucket may be aligned with the printing station and a print job may be performed. The print bucket 510 may comprise a powder platform, e.g. at an upper side of the print bucket 510, where powder may be deposited to generate the printed product. The printing station 550 may further comprise printing elements such as a powder levelling roller or a blade, a powder agent deposition system and a powder melting heating element that may be operable during the printing mode. The final printed product may rest on the powder platform until it is cool enough to be removed. For that purpose, the print bucket 510 may be removed (unmounted) from the printing station before the printed product is removed from the powder platform to free up resources, i.e. to allow for a next print job to begin with another build unit before the printed product is removed from the powder platform of the previous build unit. While the printed product is cooling the printing system may be considered in a resting mode while the print bucket 510 is resting on the trolley 505 and until another build unit is inserted to commence a new print job or until the product is cool enough to be removed so that the same build unit may be reintroduced in the printing station for a next print job.

Figure 6:
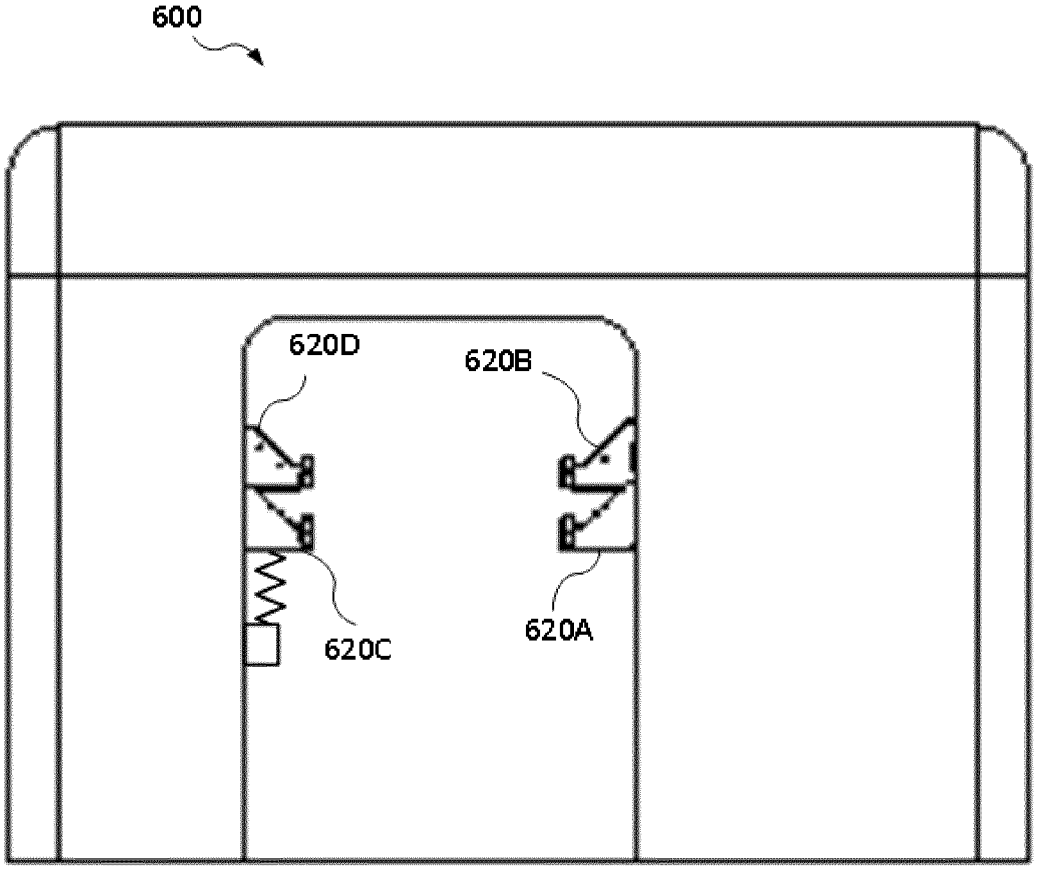
FIG. 6 is a front view of a schematic diagram of a printing station according to an example implementation.

FIG. 6 is a front view of a schematic diagram of a printing station according to an example implementation. The printing station 650 may have an opening to receive a build unit. Inside the opening, at opposing walls of the opening, there may be four receiving ports 620A, 620B, 620C and 620D. Receiving ports 620A and 620B may be fixed and located at one internal wall of the station. Receiving port 620C may be adjustable for calibration purposes and receiving port 620D may be fixed at another internal wall of the station, opposite the other one. As may be seen in FIG. 6, the receiving ports 620B and 620D may be positioned higher than the receiving ports 620A and 620C. Such arrangement may be implemented when the receiving ports 620B and 620D are positioned deeper into the opening compared to the receiving ports 620A and 620C. Thus, the coupling elements of the build unit corresponding to the receiving ports 620B and 620D may pass above the receiving ports 620A and 620C to reach their corresponding receiving ports. Furthermore, the receiving port 620C may be height adjustable to allow for calibration of the printing station due to floor unevenness.

The example implementations discussed herein allow for manual adjustment of flatness of guiding parts of a potentially deformable printing station. Such flatness may be achieved by using a separate build unit that may be inserted and coupled to an adjustable receiving port of the printer station prior to operation.

Although a number of particular implementations and examples have been disclosed herein, further variants and modifications of the disclosed devices and methods are possible. For example, not all the features disclosed herein are included in all the implementations, and implementations comprising other combinations of the features described are also possible. As such, representative examples of the present disclosure have utility over a wide range of applications, and the above discussion is not intended and should not be construed to be limiting, but is offered as an illustrative discussion of aspects of the disclosure. What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

The invention claimed is:

1. A printing station to receive a build unit, the build unit being insertable into the printing station and the build unit having four fixed mounting elements, the first and the second mounting elements being on a first lateral side of the build unit and the third and the fourth on a second lateral side of the build unit, opposite to the first lateral side, the printing station comprising:

a first wall comprising two fixed receiving ports to engage with the first and the second fixed mounting elements, respectively, when the build unit is inserted into the printing station;

a second wall, opposite to the first wall, the second wall comprising a third fixed receiving port to engage with the third fixed mounting element, when the build unit is inserted into the printing station, and a calibration receiving port to be coupled to the fourth fixed mounting element when the build unit is inserted into the printing station, wherein the calibration receiving port comprises a moveable element to accommodate the fourth fixed mounting element so as to calibrate the printing station to a plane of a build platform of the build unit.

2. The printing station according to claim 1, wherein the second wall comprises a guiding track, wherein the moveable element is moveably coupled to the guiding track.

3. The printing station according to claim 2, the guiding track comprising locking elements to lock the moveable element to an engaging location when the moveable element is engaged with the fourth fixed mounting element.

4. The printing station according to claim 2, the moveable element comprises a receiving portion and a spring, the spring to provide movement of the receiving portion in an engaging direction.

5. The printing station according to claim 4, wherein the engaging direction is a vertical direction.

6. The printing station according to claim 2, comprising a moveable linear guide element fixedly coupled to the first wall and to the moveable element.

7. The printing station according to claim 6, comprising a fixed linear guide element, fixedly coupled to the first wall and to the second wall, the moveable linear guide element to be aligned parallel to the fixed linear guide element when the calibration receiving port is coupled to the fourth fixed mounting element.

8. The printing station according to claim 7, comprising a third wall, attached to and perpendicular to the first wall and to the second wall, wherein the third wall comprises the fixed linear guide element.

9. The printing station according to claim 1, wherein coupling the calibration receiving port to the fourth fixed mounting element compensates for a warping effect of an uneven floor on which the printing station is located.

10. The printing station according to claim 1, wherein each fixed receiving port comprises an upwardly sloping ramp, at an upper end of which, is a pocket extending below the upper end of the ramp.

11. The printing station according to claim 1, wherein two of the receiving ports that are closer to where the build unit enters the printing station are vertically lower that two other of the receiving ports that are further from where the build unit enters the printing station.

12. A printing system, comprising:

a printing station and a build unit insertable into the printing station, the build unit comprising a trolley, and a print bucket, mounted on the trolley, the print bucket comprising four fixed coupling elements, respectively engageable to three fixed receiving ports of the printing station and to a fourth calibration receiving port of the printing station;

the printing station further comprising a moveable linear guide element fixedly coupled to the printing station and to the calibration receiving port;

a fixed linear guide element, fixedly coupled between sidewalls of the printing station, the moveable linear guide element to be aligned parallel to the fixed linear guide element when the calibration receiving port is coupled to a fourth fixed coupling element of the print bucket.

13. The printing station according to claim 12, each fixed coupling element comprises a bearing, each receiving port comprises a ramp and a pocket, each ramp to receive and lead the respective bearing to the respective pocket.

14. The printing system according to claim 12, comprising a first wall having two of the three fixed receiving ports, and a second wall, opposite to the first wall, the second wall having the third fixed receiving port and the calibration receiving port.

15. The printing system according to claim 14, the printing station further comprising the moveable linear guide element fixedly coupled to the first wall and to the calibration receiving port;

the fixed linear guide element, fixedly coupled to the first wall and to the second wall.

16. The printing system according to claim 12, comprising a powder-processing 3D printing system.

17. The printing system according to claim 16, the print bucket comprising a build platform to receive powder, the printing station comprising a printing module, displaceable along the fixed linear guide element and the moveable guide element, to provide ink on a part of the powder on the top side of the print bucket, and a powder melting heating element, to melt the inked part of the powder.

18. The printing station according to claim 12, wherein the moveable linear guide element comprises a pivot slot to facilitate alignment with the fixed linear guide element.

19. The printing system according to claim 12, wherein two of the receiving ports that are first encountered when the trolley is inserted into the printing station are vertically lower than two others of the receiving ports further from where the trolley enters the printing station.

* * * * *